US009114325B1

(12) United States Patent
Sternhill

(10) Patent No.: US 9,114,325 B1
(45) Date of Patent: Aug. 25, 2015

(54) MODULAR TOY BUILDING KIT SYSTEM

(71) Applicant: Yitzchok Sternhill, Brooklyn, NY (US)

(72) Inventor: Yitzchok Sternhill, Brooklyn, NY (US)

( * ) Notice: Subject to any disclaimer, the term of this patent is extended or adjusted under 35 U.S.C. 154(b) by 0 days.

(21) Appl. No.: 14/184,205

(22) Filed: Feb. 19, 2014

(51) Int. Cl.
*A63H 33/08* (2006.01)
*A63H 33/06* (2006.01)

(52) U.S. Cl.
CPC ..... *A63H 33/067* (2013.01)

(58) Field of Classification Search
USPC ..... 446/108, 111, 112, 113, 115, 122, 123
See application file for complete search history.

(56) References Cited

U.S. PATENT DOCUMENTS

| | | | | | |
|---|---|---|---|---|---|
| 195,689 | A | * | 9/1877 | Quackenbush | 446/96 |
| 1,147,378 | A | * | 7/1915 | Cronkhite | 52/588.1 |
| 1,792,976 | A | * | 2/1931 | Gilbert | 446/112 |
| 1,985,032 | A | * | 12/1934 | Hoult | 446/122 |
| 2,587,798 | A | * | 3/1952 | Wilcox | 446/109 |
| 2,589,952 | A | * | 3/1952 | Mercier | 446/123 |
| 2,733,786 | A | * | 2/1956 | Drake | 52/633 |
| 2,871,619 | A | * | 2/1959 | Walters | 446/110 |
| 3,604,146 | A | * | 9/1971 | Winer | 446/122 |
| 3,645,036 | A | * | 2/1972 | Biesterfeld et al. | 446/95 |
| 4,270,302 | A | * | 6/1981 | Dandia | 446/105 |
| 4,389,808 | A | * | 6/1983 | Podell et al. | 446/123 |
| 4,903,451 | A | * | 2/1990 | Gresswell | 52/584.1 |
| 5,040,797 | A | | 8/1991 | Dykstra | |
| 5,293,725 | A | | 3/1994 | Matticks et al. | |
| 6,014,842 | A | * | 1/2000 | Matsubara | 52/79.12 |
| D423,606 | S | | 4/2000 | Glickman et al. | |
| 6,568,981 | B1 | | 5/2003 | Chang | |
| 6,609,336 | B2 | * | 8/2003 | Matsubara | 52/79.12 |
| 7,581,357 | B2 | | 9/2009 | Richardson et al. | |
| 7,967,656 | B2 | * | 6/2011 | Hu | 446/123 |
| 8,082,709 | B2 | * | 12/2011 | Roberts | 52/284 |
| D677,342 | S | | 3/2013 | Hall | |
| 8,769,908 | B1 | * | 7/2014 | Santini | 52/656.9 |
| 2004/0198141 | A1 | | 10/2004 | Buhrman et al. | |
| 2005/0266767 | A1 | | 12/2005 | Jeske | |
| 2009/0081918 | A1 | | 3/2009 | Shen, Jr. | |
| 2009/0239441 | A1 | * | 9/2009 | Hu | 446/123 |
| 2012/0122368 | A1 | | 5/2012 | Jensen | |

FOREIGN PATENT DOCUMENTS

| | | |
|---|---|---|
| GB | 1325643 | 8/1973 |

* cited by examiner

*Primary Examiner* — Kurt Fernstrom

(57) ABSTRACT

A modular toy building kit system allows a person to build various structures, including rooms, houses or the like. The system includes a plurality of panels. Each of the panels has a base wall and a perimeter wall coupled to and extending downwardly from an outer edge of the base wall. Each of the panels is removably couplable to an adjacently positioned one of the panels. A plurality of posts is provided. Each of the posts has a top side, a bottom side and a peripheral wall coupled to and extending between the top side and the bottom side. Each of the posts is removably couplable to and positionable between adjacently positioned ones of the panels.

12 Claims, 5 Drawing Sheets

MODULAR TOY BUILDING KIT SYSTEM

BACKGROUND OF THE DISCLOSURE

Field of the Disclosure

The disclosure relates to building kit systems and more particularly pertains to a new building kit system for allowing a person to build various structures, including rooms, houses or the like.

SUMMARY OF THE DISCLOSURE

An embodiment of the disclosure meets the needs presented above by generally comprising a plurality of panels. Each of the panels has a base wall and a perimeter wall coupled to and extending downwardly from an outer edge of the base wall. Each of the panels is removably couplable to an adjacently positioned one of the panels. A plurality of posts is provided. Each of the posts has a top side, a bottom side and a peripheral wall coupled to and extending between the top side and the bottom side. Each of the posts is removably couplable to and positionable between adjacently positioned ones of the panels.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
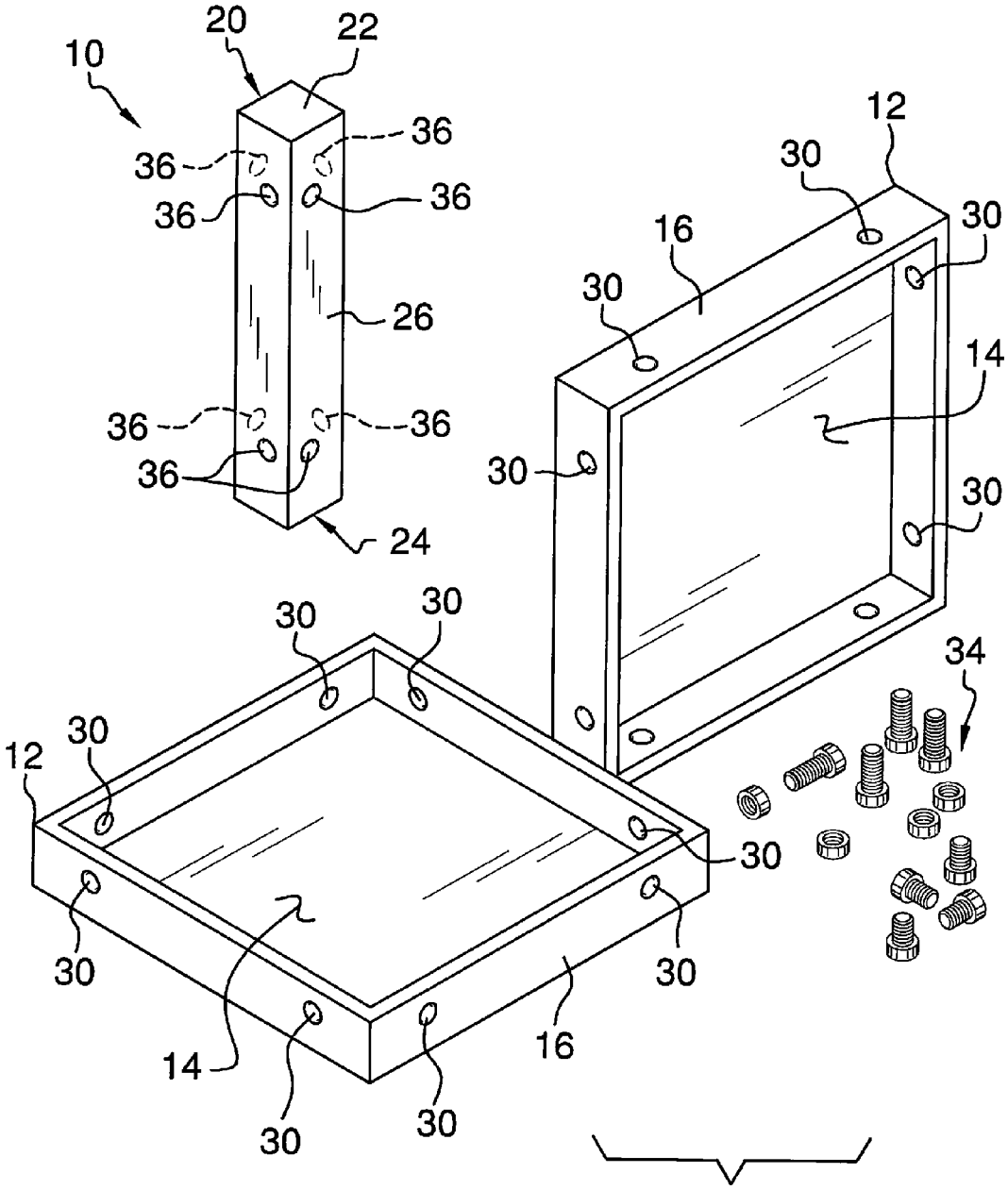
FIG. 1 is a front perspective view of a modular toy building kit system according to an embodiment of the disclosure.

With reference now to the drawings, and in particular to FIGS. 1 through 6 thereof, a new building kit system embodying the principles and concepts of an embodiment of the disclosure and generally designated by the reference numeral 10 will be described.

Figure 5:
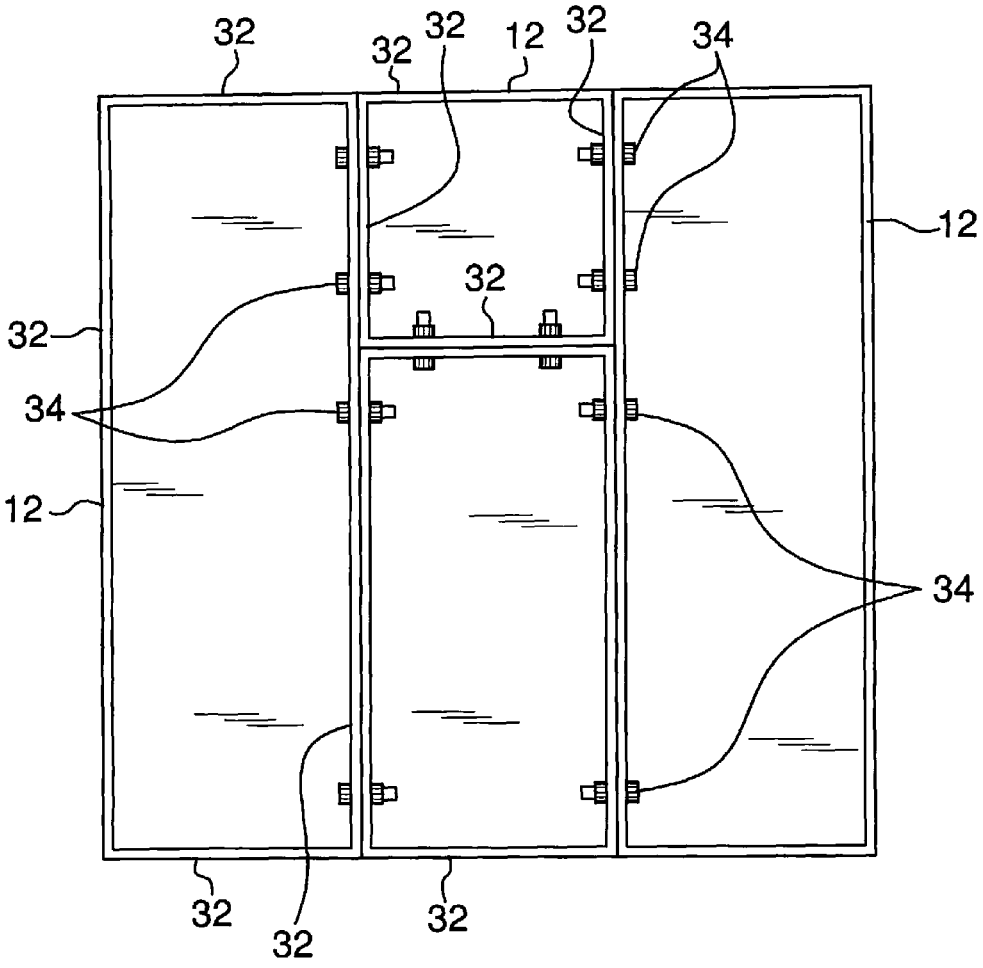
FIG. 5 is a front view of an embodiment of the disclosure showing multiple panels coupled together.

As best illustrated in FIGS. 1 through 6, the modular toy building kit system 10 generally comprises a plurality of panels 12. Each of the panels 12 has a base wall 14 and a perimeter wall 16 coupled to and extending downwardly from an outer edge 18 of the base wall 14. Each of the panels 12 is removably couplable to an adjacently positioned one of the panels 12. Each of the panels 12 may have a length between approximately 10.0 cm and 32.0 cm and a width between approximately 8.0 cm and 15.0 cm. As shown in FIG. 5, the panels 12 may have various sizes and some of the panels 12 may be elongated. Although the panels 12 are shown as being square and rectangular in the Figures, the panels 12 may be triangular, circular, or have any other suitable shape.

Figure 2:
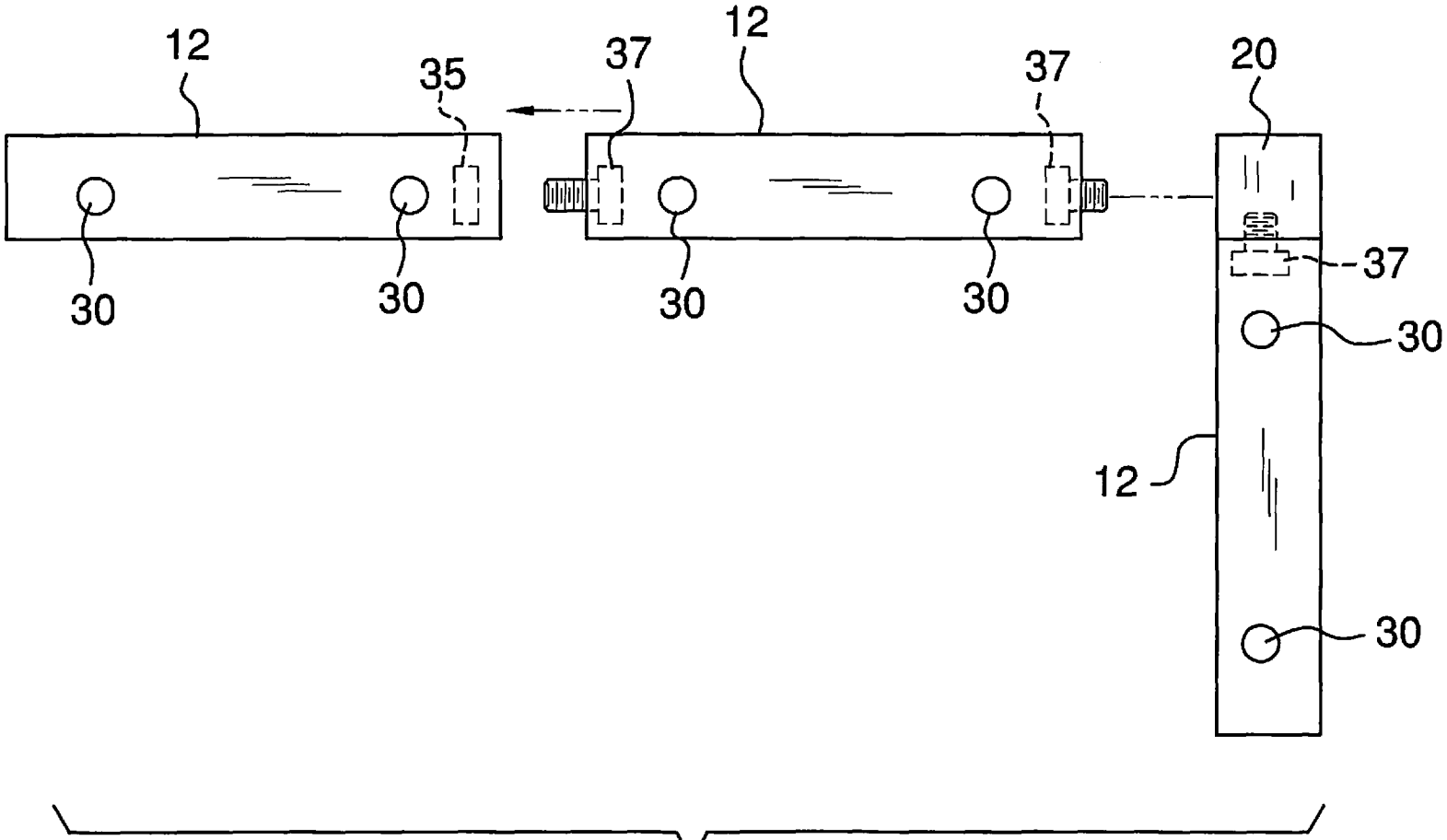
FIG. 2 is a top view of an embodiment of the disclosure.
Figure 3:
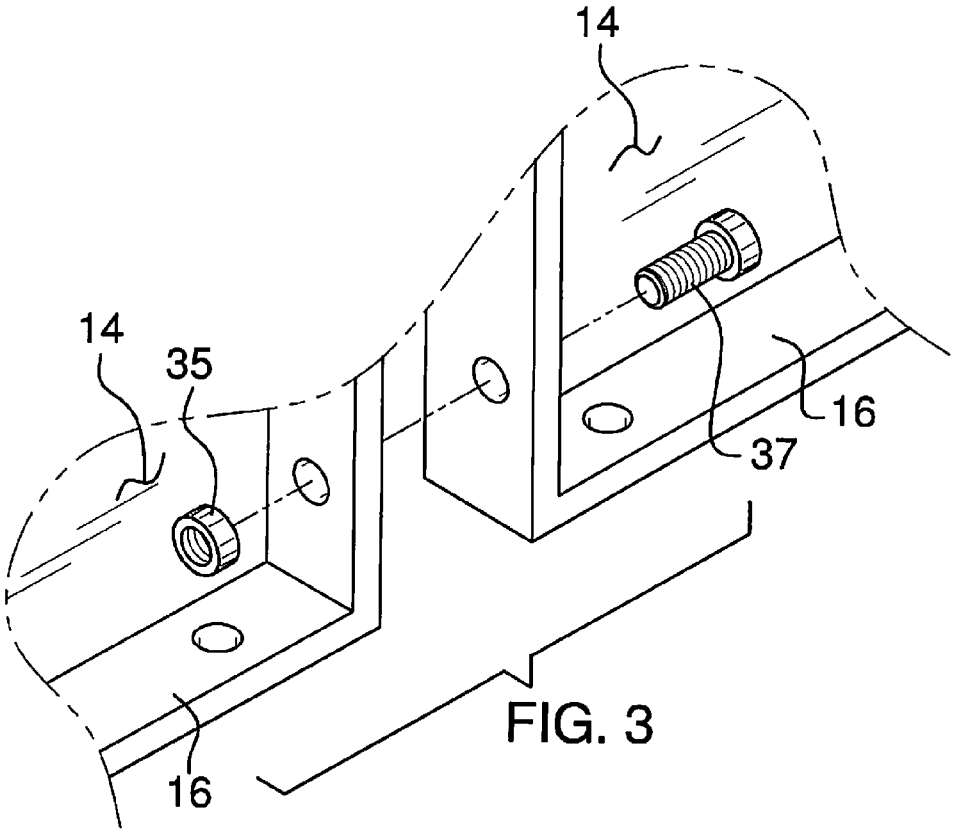
FIG. 3 is an exploded front view of an embodiment of the disclosure.
Figure 4:
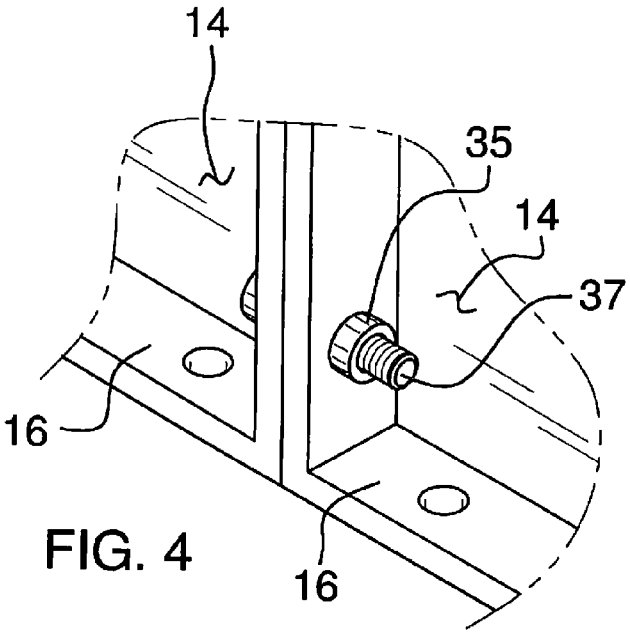
FIG. 4 is a detailed front view of an embodiment of the disclosure showing two panels coupled together.
Figure 6:
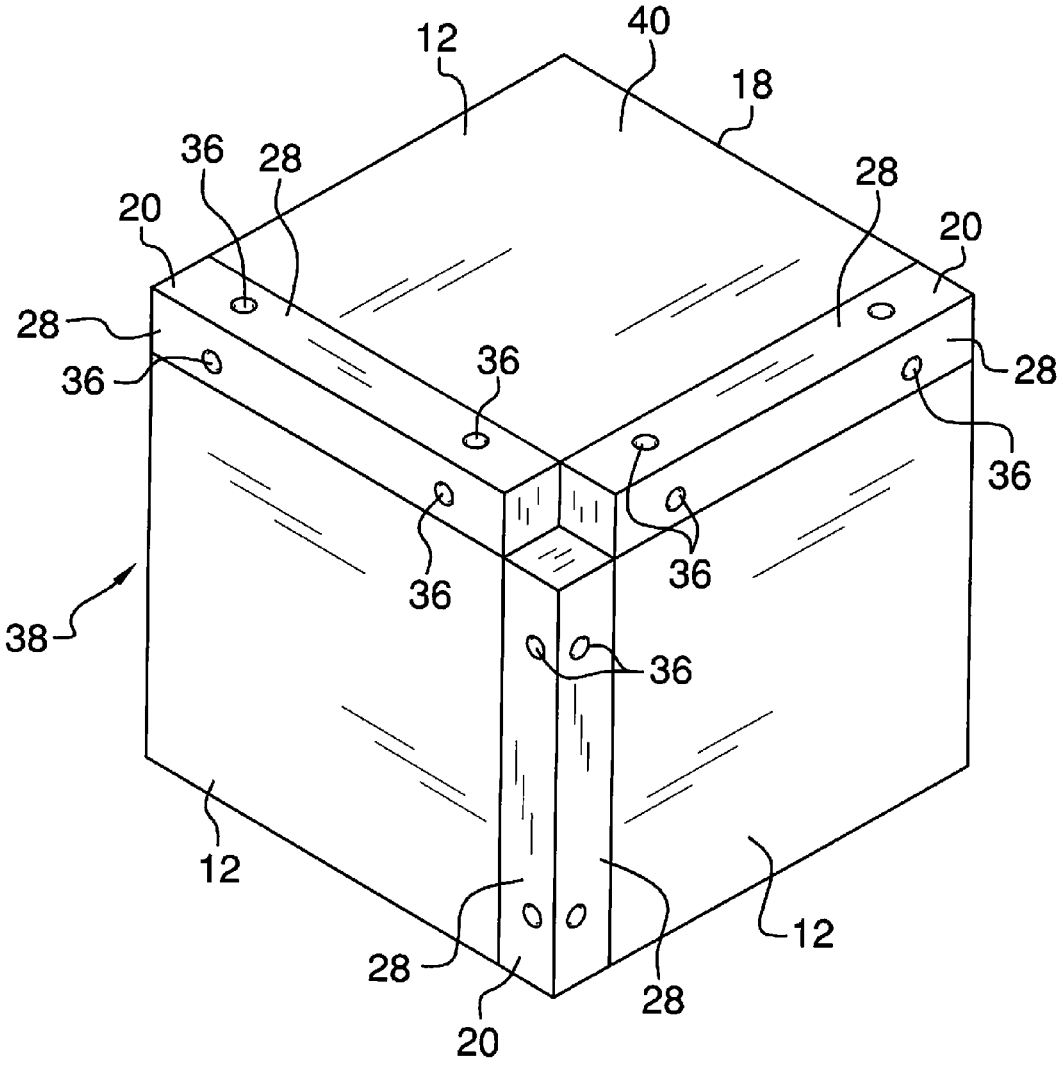
FIG. 6 is a front perspective view of an embodiment of the disclosure showing multiple panels coupled together using a plurality of posts.

A plurality of posts 20 is provided. Each of the posts 20 has a top side 22, a bottom side 24 and a peripheral wall 26 coupled to and extending between the top side 22 and the bottom side 24. The peripheral wall 26 of each post 20 comprises a plurality of planar faces 28. The top side 22 and the bottom side 24 of each post 20 is also planar. The peripheral wall of each said post has a square cross-sectional shape transverse to a longitudinal axis of said post, said square cross-sectional shape being consistent extending a full length between said top side and said bottom side wherein each said post is a single elongated rectangular parallelepiped. Each of the posts 20 is removably couplable to and positionable between adjacently positioned ones of the panels 12. As shown in FIG. 2 and FIG. 6, the posts 20 can be attached to the panels 12 to allow the panels 12 to form right angles relative to each other. In particular, FIG. 6 shows how the system 10 can be used to form a house-like structure 38 in which a panel 12 that is horizontally positioned to extend across a top of house-like structure 38 defines a roof 40 of the house-like structure 38. If desired, a user can also attach the posts 20 and the panels 12 to create walls, rooms, multiple floors or the like.

A plurality of holes 30 is positioned in each of the panels 12. Each of the holes 30 is positioned in the perimeter wall 16 of the associated panel 12. In particular, the holes 30 are positioned in each side 32 of the perimeter wall 16. A plurality of fasteners 34 extends through and engages a pair of holes 30 in adjacently positioned ones of the panels 12 to releasably couple together the adjacently positioned ones of the panels 12. The fasteners 34 are generally conventional and include nuts 35 and bolts 37 or the like. However, the fasteners 34 may be constructed from plastic or like material to make playing with the system 10 more safe for children. A plurality of apertures 36 is positioned in each of the posts 20. Each of the fasteners 34 is extendable through a selectable one of the holes 30 and a selectable one of the apertures 36 to releasably couple together one of the posts 20 and one of the panels 12. The apertures 36 are positioned in the peripheral wall 26 of each post 20. In particular, the apertures 36 are positioned in each planar face 28 of the peripheral wall 26.

In use, as stated above and shown in the Figures, the panels 12 and the posts 20 are attached together using the fasteners 34. The user can assemble the panels 12 and the posts 20 together to create walls, rooms, house-like structures 38 and the like. The system 12 can be quickly and easily disassembled by removing the fasteners 34 to enable the user to continuously build different structures.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular toy building kit system comprising:

a plurality of panels, each of said panels having a base wall and a perimeter wall coupled to and extending downwardly from an outer edge of said base wall, each of said panels being removably couplable to an adjacently positioned one of said panels; and a plurality of posts, each of said posts having a top side, a bottom side and a peripheral wall coupled to and extending between said top side and said bottom side, said peripheral wall of each said post having a square cross-sectional shape transverse to a longitudinal axis of said post, said square cross-sectional shape being consistent extending a full length between said top side and said bottom side wherein each said post is a single elongated rectangular parallelepiped, each of said posts being removably couplable to and positionable between adjacently positioned ones of said panels.

2. The system of claim 1, further comprising:

a plurality of holes positioned in each of said panels; and a plurality of fasteners extending through and engaging a pair of said holes in adjacently positioned ones of said panels to releasably couple together said adjacently positioned ones of said panels.

3. The system of claim 2, further comprising a plurality of apertures positioned in each of said posts, each of said fasteners being extendable through a selectable one of said holes and a selectable one of said apertures to releasably couple together one of said posts and one of said panels.

4. The system of claim 2, further comprising each of said holes being positioned in said perimeter wall of said associated panel.

5. The system of claim 4, further comprising said holes being positioned in each side of said perimeter wall.

6. The system of claim 3, further comprising said apertures being positioned in said peripheral wall of each said post.

7. The system of claim 6, further comprising said apertures being positioned in each face of said peripheral wall.

8. The system of claim 1, further comprising said plurality of panels having various sizes.

9. The system of claim 1, further comprising at least one of said panels being elongated.

10. The system of claim 1, further comprising said peripheral wall of each said post comprising a plurality of planar faces.

11. The system of claim 1, further comprising said top side and said bottom side of each said post being planar.

12. A modular toy building kit system comprising:

a plurality of panels, each of said panels having a base wall and a perimeter wall coupled to and extending downwardly from an outer edge of said base wall, each of said panels being removably couplable to an adjacently positioned one of said panels, said plurality of panels having various sizes, at least some of said panels being elongated;

a plurality of posts, each of said posts having a top side, a bottom side and a peripheral wall coupled to and extending between said top side and said bottom side, said peripheral wall of each said post comprising a plurality of planar faces, said top side and said bottom side of each said post being planar, said peripheral wall of each said post having a square cross-sectional shape transverse to a longitudinal axis of said post, said square cross-sectional shape being consistent extending a full length between said top side and said bottom side wherein each said post is a single elongated rectangular parallelepiped, each of said posts being removably couplable to and positionable between adjacently positioned ones of said panels;

a plurality of holes positioned in each of said panels, each of said holes being positioned in said perimeter wall of said associated panel, said holes being positioned in each side of said perimeter wall;

a plurality of fasteners extending through and engaging a pair of said holes in adjacently positioned ones of said panels to releasably couple together said adjacently positioned ones of said panels; and a plurality of apertures positioned in each of said posts, each of said fasteners being extendable through a selectable one of said holes and a selectable one of said apertures to releasably couple together one of said posts and one of said panels, said apertures being positioned in said peripheral wall of each said post, said apertures being positioned in each said planar face of said peripheral wall.

* * * * *